US010959902B2

(12) United States Patent
Leier et al.

(10) Patent No.: US 10,959,902 B2
(45) Date of Patent: Mar. 30, 2021

(54) INVERSION METHODS AND APPARATUS HAVING ELECTRONICS UNIT TO ACCUMULATE DATA

(71) Applicant: EXPECTATIONS, LLC, Puyallup, WA (US)

(72) Inventors: Christopher Henry Leier, Puyallup, WA (US); Lopin Wang, Taichung (TW)

(73) Assignee: Expectations, LLC, Bonney Lake, WA (US)

( * ) Notice: Subject to any disclaimer, the term of this patent is extended or adjusted under 35 U.S.C. 154(b) by 96 days.

(21) Appl. No.: 15/928,576

(22) Filed: Mar. 22, 2018

(65) Prior Publication Data

US 2018/0271737 A1 Sep. 27, 2018

Related U.S. Application Data

(60) Provisional application No. 62/475,410, filed on Mar. 23, 2017.

(51) Int. Cl.
*A63B 21/00* (2006.01)
*A63B 21/068* (2006.01)
(Continued)

(52) U.S. Cl.
CPC ..... *A61H 1/0229* (2013.01); *A61H 1/0292* (2013.01); *A63B 21/068* (2013.01);
(Continued)

(58) Field of Classification Search
CPC ..... A63B 17/00; A63B 17/02; A63B 17/04; A63B 23/0205; A63B 23/0233; A63B 23/0211; A63B 23/0222; A63B 26/00; A63B 21/00047; A63B 21/005; A63B 21/0054; A63B 21/00185; A63B 21/4029; A63B 21/068; A63B 22/0908; A63B 2209/08; A63B 24/0062; A63B 2225/20; A63B 2225/081; A63B 2220/00; A61H 1/02; A61H 1/0229; A61H 1/0292; A61H 1/0222; A61H 2203/04; A61H 2203/0493;
(Continued)

(56) References Cited

U.S. PATENT DOCUMENTS 4,717,148 A * 1/1988 Brewer ..... A61H 1/0218 482/144
5,188,096 A 2/1993 Yoo
(Continued)

FOREIGN PATENT DOCUMENTS

CN 2772485 Y 4/2006
CN 203677874 U 7/2014
(Continued)

*Primary Examiner* — Garrett K Atkinson
*Assistant Examiner* — Zachary T Moore
(74) *Attorney, Agent, or Firm* — Dicke, Billig & Czaja, PLLC

(57) ABSTRACT

An inversion apparatus includes a support frame configured to movably support an inversion table. The support frame includes a forwardly extending foot platform that helps a user mount and dismount the apparatus when the apparatus is in an operative configuration. A CPU is preferably mounted on the inversion table to collect data and transmit to an output device, such as a mobile phone.

13 Claims, 8 Drawing Sheets

(51) Int. Cl.
*A63B 24/00* (2006.01)
*A63B 26/00* (2006.01)
*A61H 1/02* (2006.01)

(52) U.S. Cl.
CPC ..... *A63B 21/4029* (2015.10); *A63B 24/0062* (2013.01); *A63B 26/00* (2013.01); *A61H 2201/0107* (2013.01); *A61H 2201/1623* (2013.01); *A61H 2201/1635* (2013.01); *A61H 2201/1642* (2013.01); *A61H 2201/5043* (2013.01); *A61H 2203/0493* (2013.01); *A61H 2205/081* (2013.01); *A63B 2209/08* (2013.01); *A63B 2225/20* (2013.01)

(58) Field of Classification Search
CPC .... A61H 2203/0481; A61H 2203/0487; A61H 2201/0134; A61H 2201/0138; A61H 2201/0142; A61H 2201/0149; A61H 2201/1253; A61H 2201/0192; A61H 2201/1626; A61H 2201/1623; A61H 2201/1642; A61H 2201/1635; A61H 2201/1619; A61H 2201/1676; A61H 2201/0107; A61H 2201/5043; A61H 2205/081
USPC ..... 482/143, 144, 145
See application file for complete search history.

(56) References Cited

U.S. PATENT DOCUMENTS 6,244,988 B1 * 6/2001 Delman ..... A63B 71/0622 482/8
7,052,448 B2 5/2006 Teeter
7,118,518 B1 10/2006 Teeter
7,125,372 B1 10/2006 Teeter et al.
D551,725 S 9/2007 Teeter
D581,996 S 12/2008 Teeter et al.
7,507,192 B2 3/2009 Teeter et al.
7,544,157 B2 6/2009 Teeter et al.
7,562,458 B1 * 7/2009 Clark, Jr. ..... A61G 7/018 33/333
7,585,264 B1 9/2009 Wang et al.
7,625,326 B2 12/2009 Teeter et al.
7,625,327 B1 12/2009 Teeter et al.
7,663,653 B2 2/2010 Tsujino et al.
D617,855 S 6/2010 Leier
7,857,741 B1 12/2010 Hsiung
7,867,154 B2 1/2011 Teeter et al.
8,051,512 B2 11/2011 Teeter
D650,025 S 12/2011 Leier et al.
D650,026 S 12/2011 Leier et al.
D664,220 S 7/2012 Leier et al.
8,291,533 B2 10/2012 Teeter
8,480,543 B1 7/2013 Leier et al.
8,519,852 B2 * 8/2013 Johnson ..... A61G 7/05 340/573.7
8,556,787 B2 10/2013 Leier et al.
9,414,784 B1 * 8/2016 Berme ..... A61B 5/6823
9,486,382 B1 * 11/2016 Boss ..... A61B 5/746
2006/0046915 A1 3/2006 Huang
2007/0161477 A1 * 7/2007 Wang ..... A61H 1/0218 482/144
2009/0054217 A1 2/2009 Teeter
2011/0218086 A1 9/2011 Boren
2016/0279498 A1 * 9/2016 Gordon ..... A63B 71/0619
2017/0106240 A1 4/2017 Chuang
2018/0147107 A1 5/2018 Leier et al.
2018/0250186 A1 9/2018 Leier et al.

FOREIGN PATENT DOCUMENTS

CN 203829584 U 9/2014
CN 204319668 U 5/2015
CN 208193544 U 12/2018
TW M261246 U 4/2005
TW M344171 U 11/2008
TW 20130927 A 3/2013

* cited by examiner

INVERSION METHODS AND APPARATUS HAVING ELECTRONICS UNIT TO ACCUMULATE DATA

CROSS-REFERENCE TO RELATED APPLICATION

This application claims the benefit of U.S. Provisional Application No. 62/475,410, filed Mar. 23, 2017.

FIELD OF THE INVENTION

The present invention relates to exercise equipment, and more specifically, to methods and apparatus associated with inverting a person relative to an underlying floor surface.

BACKGROUND OF THE INVENTION

Along with cardio exercise and strength exercise, stretching and/or body manipulation may be considered another fundamental form of exercise or physical fitness that is important for overall health and well being. One specific form of beneficial stretching and/or body manipulation may be accomplished by inverting one's body relative to an underlying floor surface. Some examples of known inversion apparatus are disclosed in U.S. Pat. Nos. 5,967,951, 7,052,448, 7,663,653, 7,118,518, 7,125,372, 7,507,192, 7,544,157, 7,585,264, 7,625,326, 7,625,327, 7,867,154, 8,051,512, 8,291,533, 8,480,543, 8,556,787, D551,725, D581,996, D617,855, D650,025, D650,026 and D664,220. An object of the present invention is to provide new and improved inversion apparatus.

SUMMARY OF THE INVENTION

Generally speaking, the present invention may be described as improvements to inversion apparatus that support a user in an inverted position relative to an underlying floor surface, which may be practiced individually and/or in various combinations.

One improvement may be described in terms of a data collecting and transmitting unit mounted on the tilting inversion table of an inversion apparatus. The unit includes at least one sensor for sensing at least the frequency of inversion and preferably the duration and angle(s) of inversion, as well. The accumulated information is then preferably communicated to the user via a mobile phone app. In an alternative configuration, the information may be communicated to the user via a display device mounted on the inversion apparatus. Such a unit may be integrated into the table of an inversion apparatus or configured for retrofit onto an existing inversion table. Various features and benefits of the present invention will become apparent from the more detailed description that follows.

BRIEF DESCRIPTION OF THE DRAWING

With reference to the Figures of the Drawing, wherein like numerals represent like parts and assemblies throughout the several views.

DETAILED DESCRIPTION OF THE PREFERRED EMBODIMENT

Figure 1:
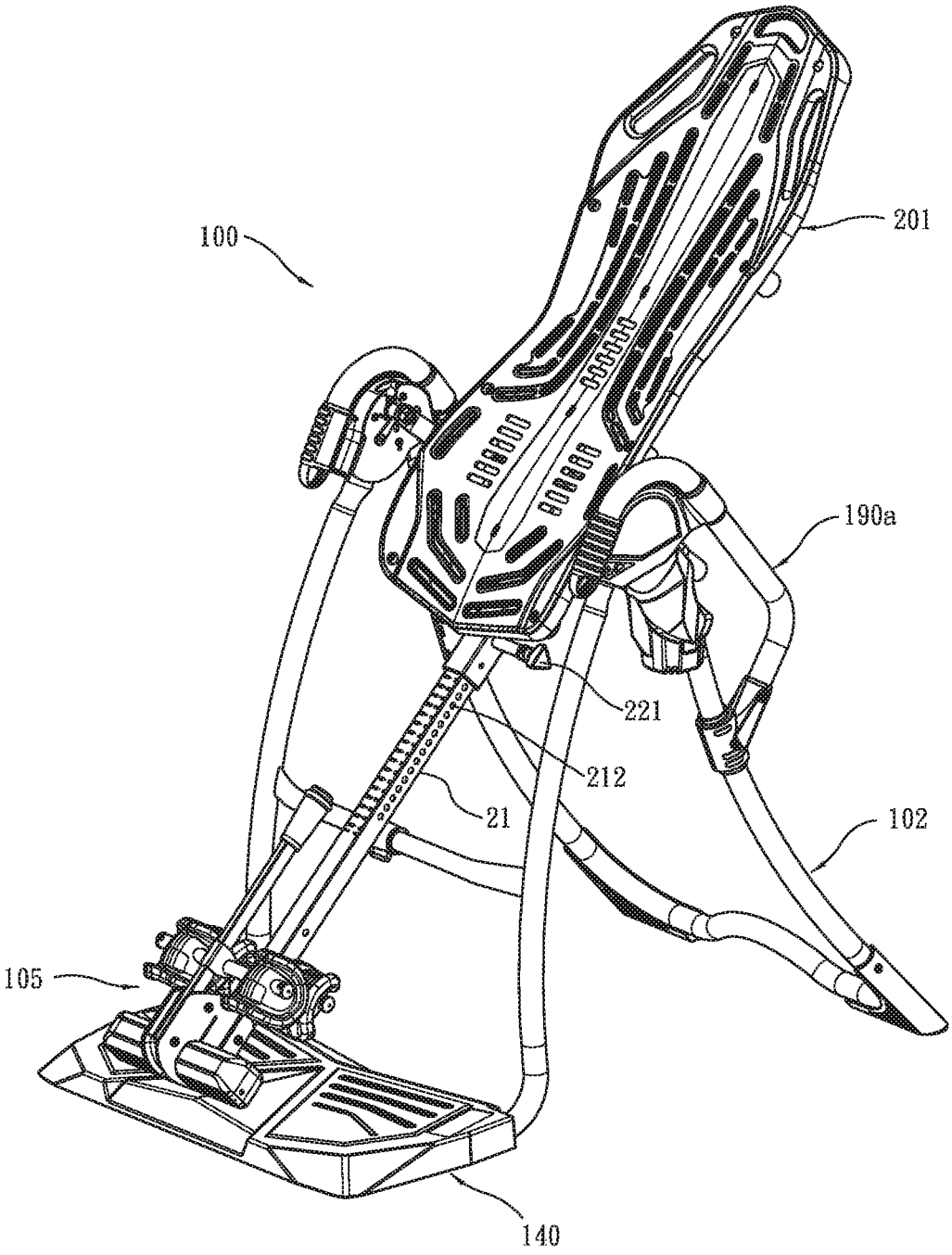
FIG. 1 is a perspective view of an inversion apparatus constructed according to the principles of the present invention.
Figure 2:
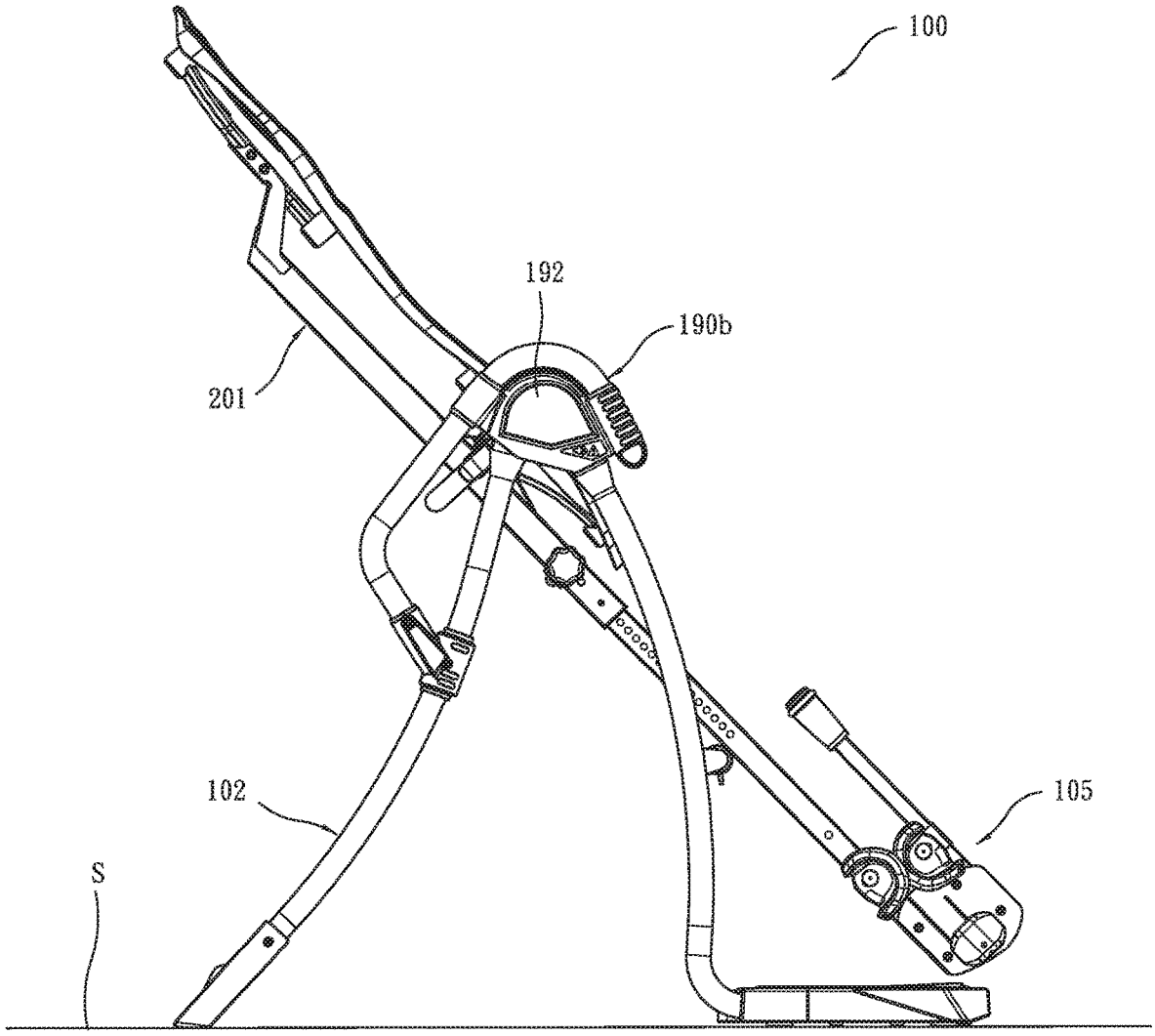
FIG. 2 is a side view of the inversion apparatus of FIG. 1.

FIGS. 1-2 show a preferred embodiment inversion apparatus 100 constructed according to the principles of the present invention. The apparatus 100 shares attributes with and/or may be implemented with components from one or more of the inversion apparatus disclosed in U.S. Pat. Nos. 5,967,951, 7,052,448, 7,663,653, 7,118,518, 7,125,372, 7,507,192, 7,544,157, 7,585,264, 7,625,326, 7,625,327, 7,867,154, 8,051,512, 8,291,533, 8,480,543, 8,556,787, D551,725, D581,996, D617,855, D650,025, D650,026 and D664,220, all of which are incorporated herein by reference.

The inversion apparatus 100 includes a support frame 102 that pivotally supports an inversion bed or table 201 at an elevation above a floor surface S. FIGS. 1-2 show the inversion apparatus 100 in a deployed or operative configuration to support a user while pivoting through a range of orientations relative to the underlying floor surface S, from approximately upright to completely upside down. This disclosure focuses on certain features of the apparatus 100 with the understanding that features also may be gleaned from the above-referenced patents.

Generally speaking, the support frame 102 is a selectively foldable A-frame preferably made of steel tubes (two of which are designated as 190*a* and 190*b*). The support frame 102 is configured to occupy a stable position relative to the underlying floor surface S, and to define a pivot axis 192, which extends perpendicular to the drawing sheet and toward the reader in FIG. 2. A foot platform 140 is preferably mounted to the front of the support frame 102 to accommodate the feet of a user prior to mounting the apparatus 100 and/or when dismounting the apparatus 100.

Figure 3:
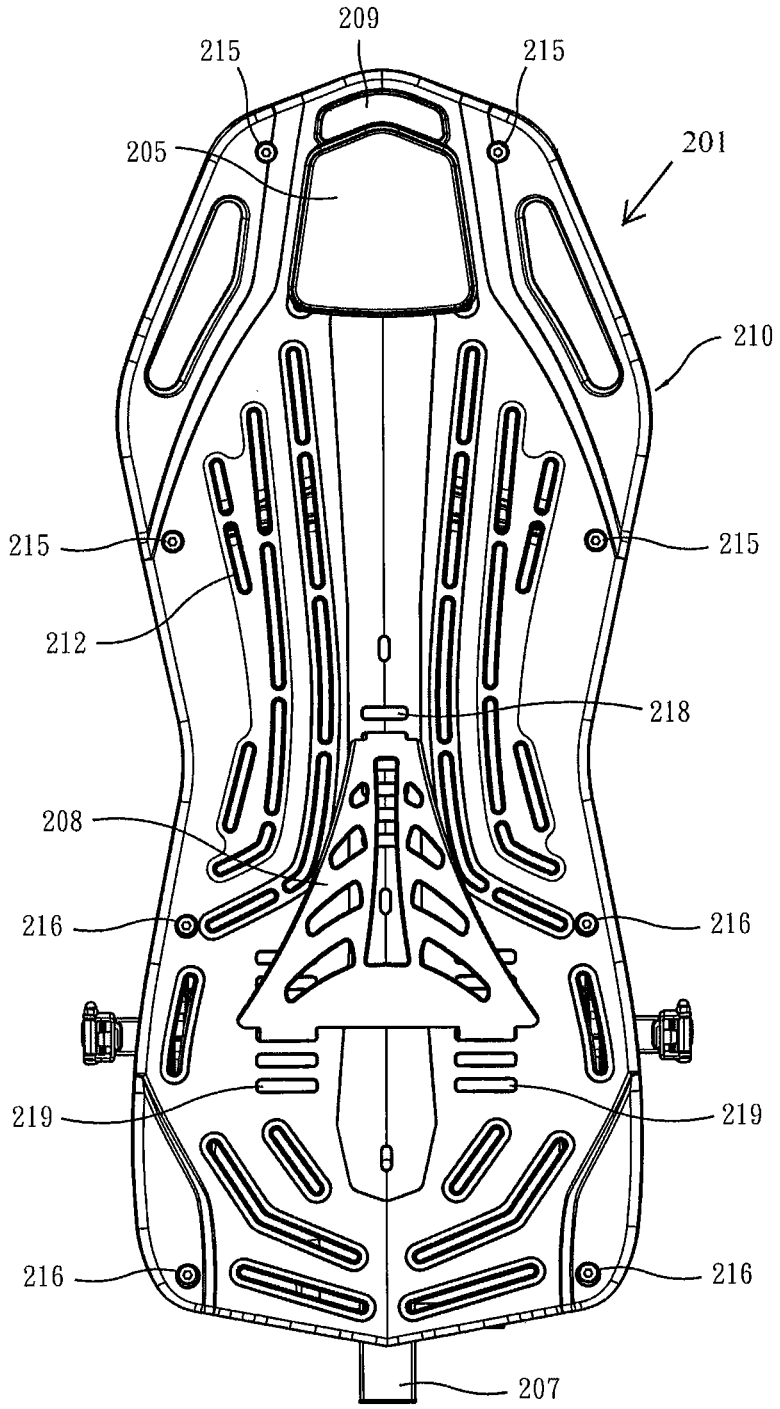
FIG. 3 is a top view of an inversion table that is part of the inversion apparatus shown in FIGS. 1-2.
Figure 4:
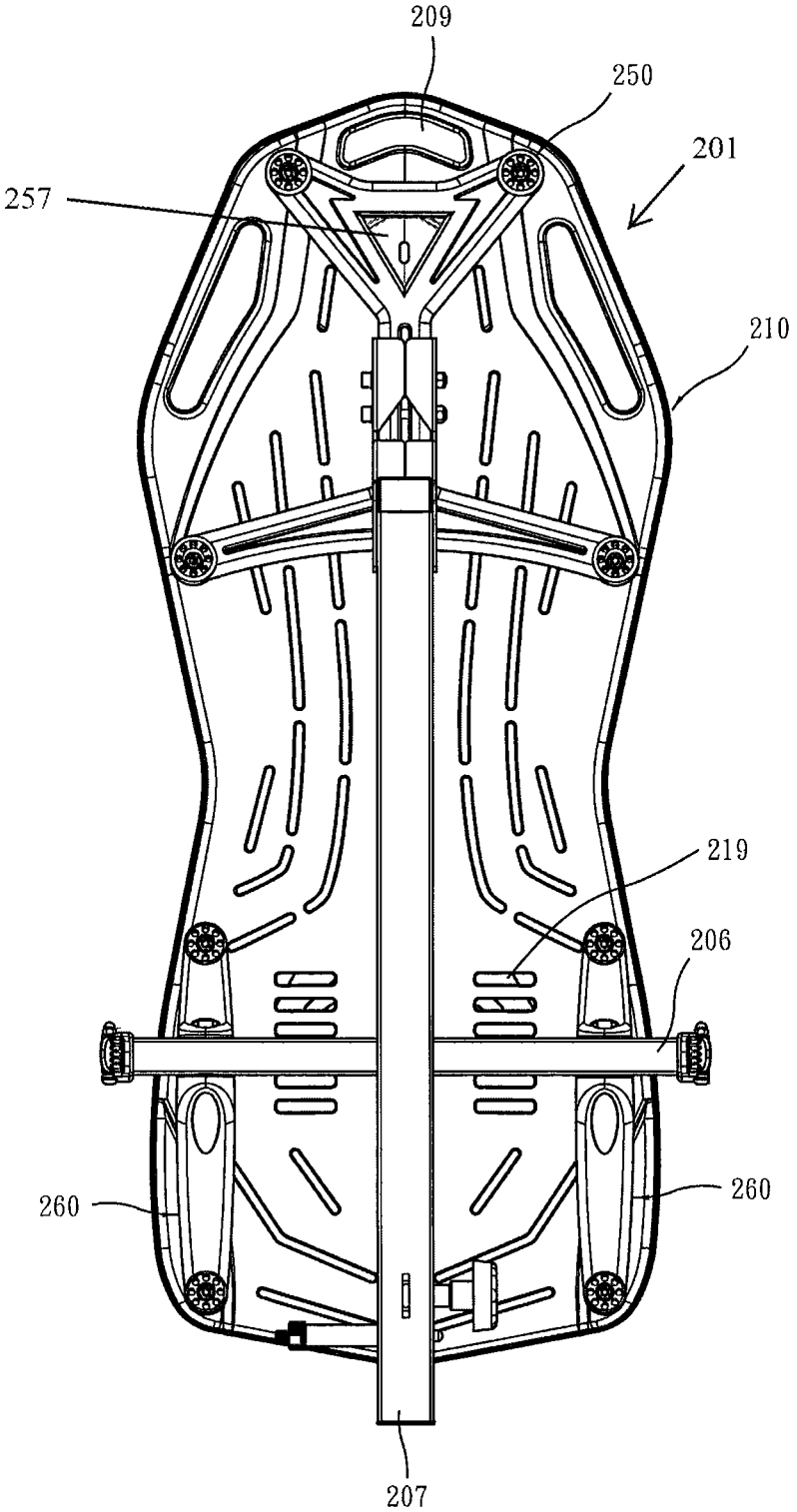
FIG. 4 is an opposite, bottom view of the inversion table of FIG. 3.

FIGS. 3-4 show and/or reference various details of the bed or table 201, which includes a body engaging platform 210 preferably made of injection molded plastic. As shown in FIG. 4, the platform 210 is supported by underlying ribs or brackets 250 and 260 (also preferably made of injection molded plastic). More specifically, four fasteners 215 insert through apertures in the upper half of the platform 210 and aligned apertures in an upper bracket 250, and four fasteners 216 insert through apertures in the lower half of the platform 210 and aligned apertures in respective left and right lower brackets 260. A cross bar 206, preferably a square steel tube, is interconnected between the left and right brackets 260, and a longitudinal bar 207, preferably a square steel tube, is interconnected between the cross bar 206 and the upper bracket 250.

With reference to FIG. 1, an extension or lower leg support 21 has an upper end that is secured inside the longitudinal bar 207 in a manner known in the art. In this regard, the upper end of the extension 21 slides or telescopes inside the bar 207, and is selectively latched in place by a spring-loaded pin or plunger assembly 221 that inserts through an aperture in the bar 207 and an aligned aperture 212 in the extension 21. The extension 21 has an opposite, lower end that supports a leg engaging assembly 105 to support/restrain a user's feet/ankles in a manner known in the art.

Proximate a head end or upper end of the platform 210, an opening 209 extends through the platform to provide a hand grip. Just beneath this opening 209, a head pad 205 (shown in FIG. 3) is releasably mounted on the platform 210, preferably by mounting means known in the art, such as but not limited to hook-and-loop fasteners and snap fasteners, for example. Additional left and right hand grip openings are provided along the periphery of the platform 210 to the respective left and right sides of the head pad 205.

The platform 210 is symmetrical relative to a plane extending through the longitudinal axis of the longitudinal bar 207 (and perpendicular to the drawing sheets of FIGS. 3 and 4). As shown in FIG. 3, near the center of the platform 210, laterally arranged slots 218 extend through the platform 210 (and across this plane of symmetry). Further down, laterally arranged arrays of left and right slots 219 extend through the platform 210 (on respective sides of the plane of symmetry). In a manner known in the art, the slots 219 and 218 cooperate to releasably support a lumbar bridge 208 in any of several arrangements on the platform 210. The bow or curvature of the lumbar bridge 208 is determined by distance between the slots 218 and 219 engaged by respective ends of the lumbar bridge 208. In other words, the lumbar bridge 208 must be bent to a greater extent to fit into first and second slots 218 and 219 that are relatively closer to one another.

Figure 5A:
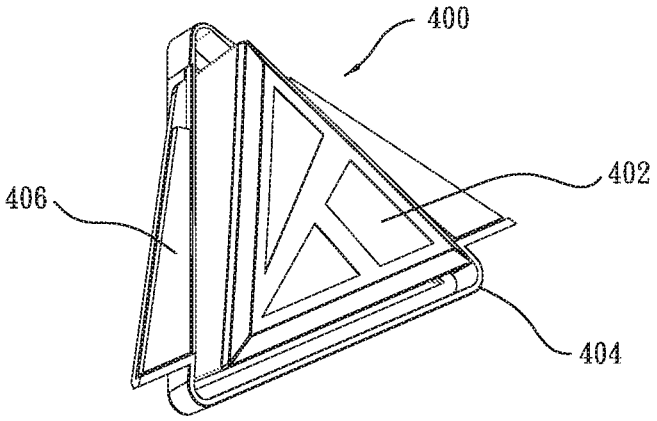
FIG. 5*a* is a perspective view of an electronics module sized and configured for mounting on the inversion table of FIGS. 3-4.
Figure 5B:
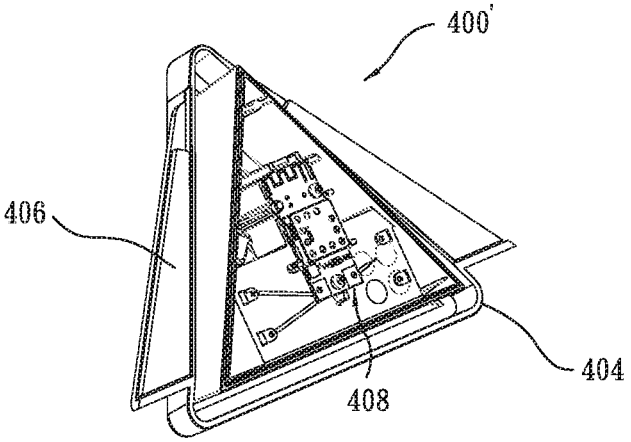
FIG. 5*b* is the same perspective view of the electronics module of FIG. 5*a* with a cover panel removed.
Figure 6:
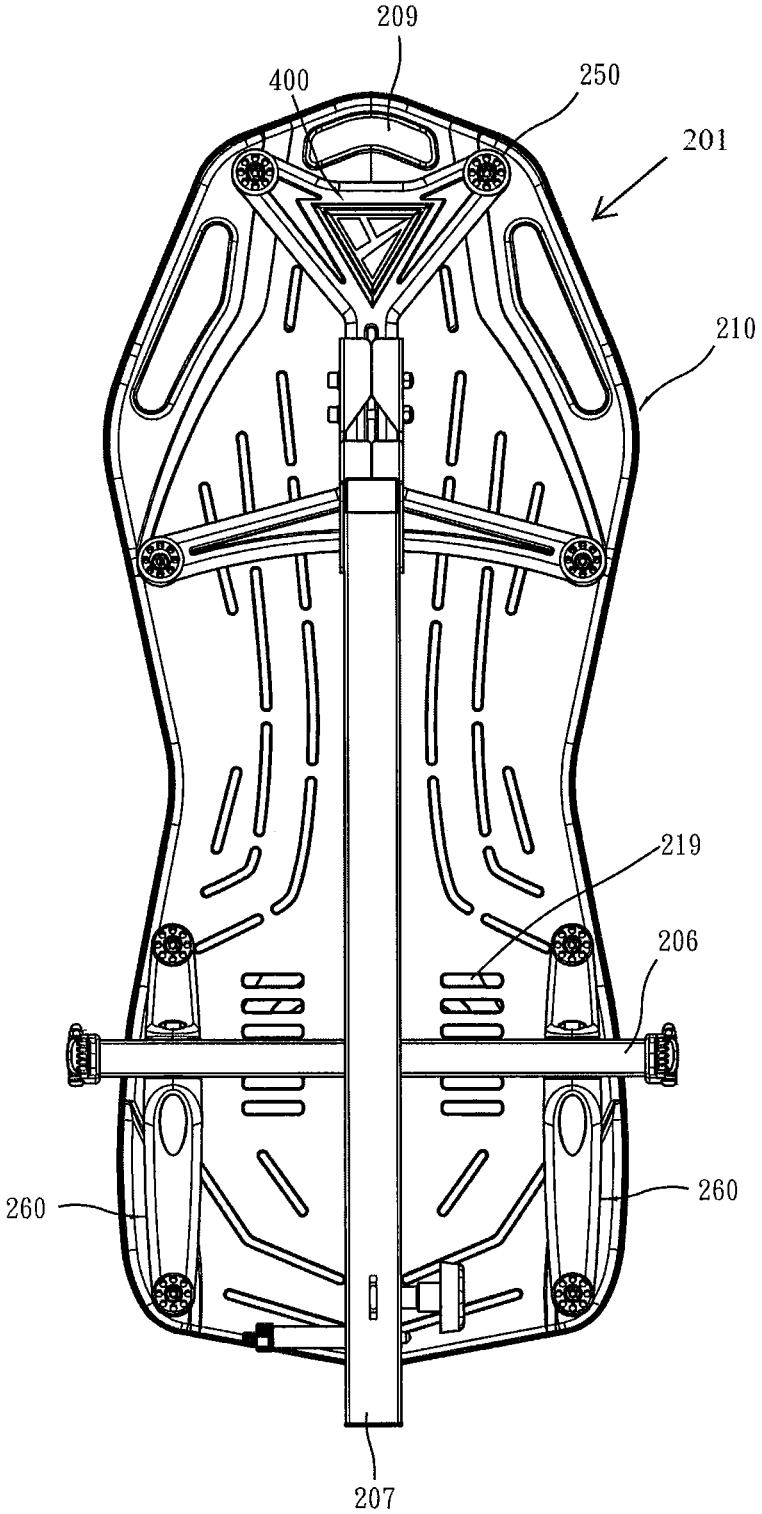
FIG. 6 is the same bottom view of the inversion table of FIG. 4 with the electronics module of FIG. 5*a* mounted thereon.

FIG. 5*a* shows an electronics module 400 that is mounted on the bed 201 between the upper bracket 250 and the platform 210 (as shown in FIG. 6). The module 400 includes a shell 404 and a cover 402 that cooperate to form a housing. FIG. 5*b* shows the module 400' with the cover 402 removed to reveal the internal components, which are collectively designated as 408.

Figure 8:
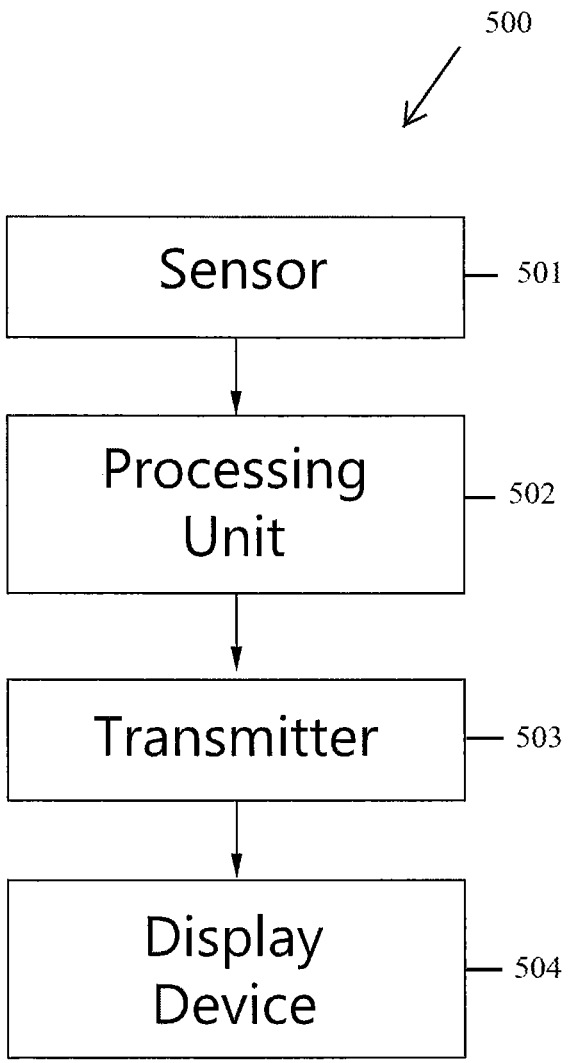
FIG. 8 is a flow chart illustrating operation of the electronics module of FIGS. 5*a* and 5*b*.

The internal components 408 preferably include at least a power source, a processing unit, a sensor, and a transmitter, all of which operate and are interconnected in a manner known in the art. As illustrated in a method 500 of FIG. 8, the processing unit is programmed in one of several ways to accumulate data from the sensor at 501-502 and transmit data to a display device via a transmitter 503-504. The display device could be a display screen and/or a mobile phone running a dedicated app for this purpose. The mobile phone app may show the raw data and/or messages based on the raw data. Collected data may include the frequency of inversions, the duration of each inversion, and the magnitude of each inversion based on changes in orientation of the supporting table relative to the floor surface.

Flanges or fins 406 project outward from opposite sides of the shell 404 to facilitate mounting on the bed 210. In this regard, the flanges 406 are configured to snap into place "behind" the upper bracket 250 (as viewed in FIG. 6) when the module 400 is press fit into an opening 257 (see FIG. 4) defined by the upper bracket 250. Other mounting methods may be used without departing from the scope of the present invention, and non-limiting examples include double-sided tape secured to the flanges 406 and pressed into adherence against an adjacent structure on the upper bracket 250; or hook-and-loop fasteners; or a screw threaded into the upper bracket 250 and/or the shell 404 to anchor the module 400 within its dedicated cavity 257.

Figure 7:
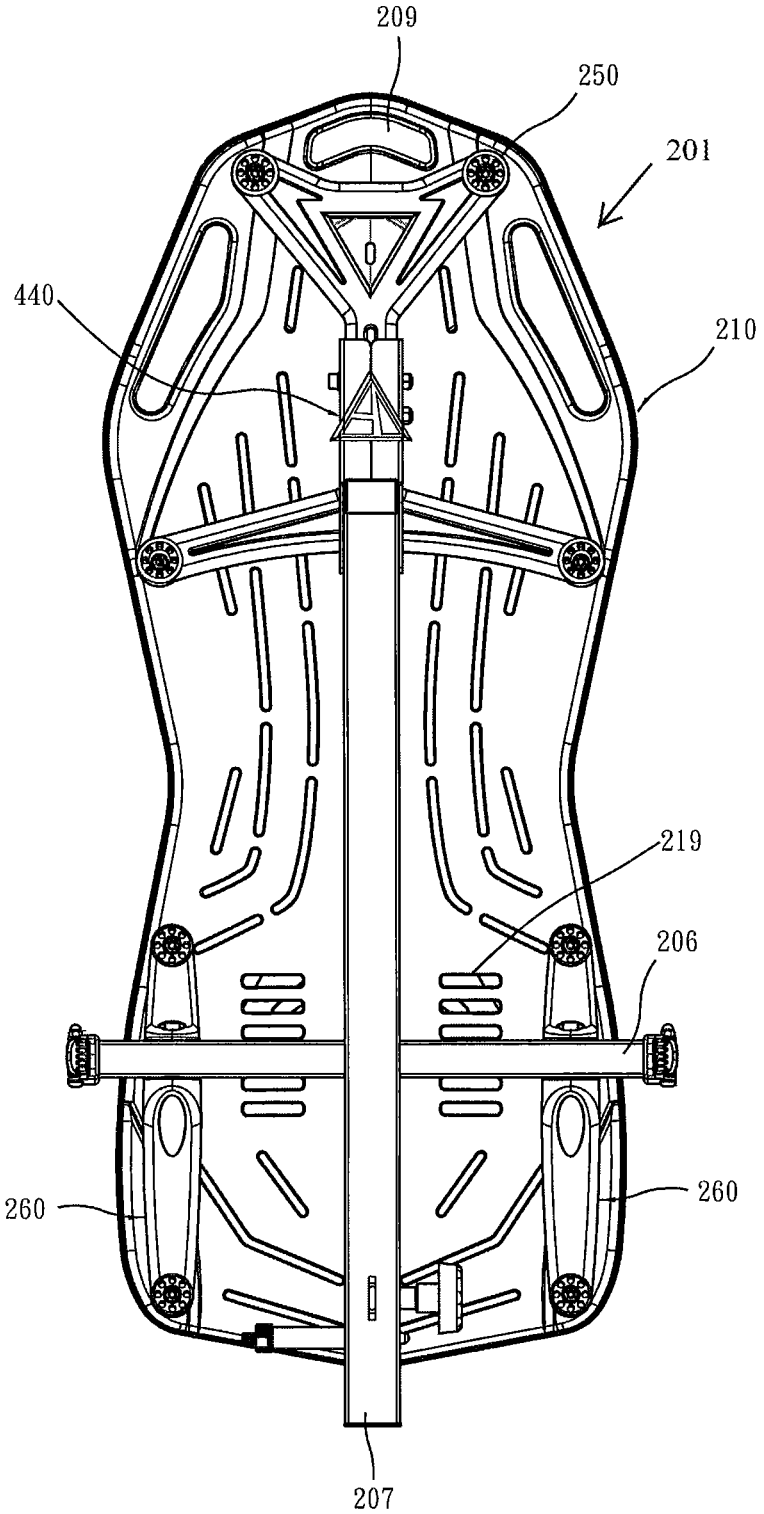
FIG. 7 is the same bottom view of the inversion table of FIG. 4 with an alternative embodiment electronics module mounted thereon.

FIG. 7 shows an alternative embodiment module 440 mounted on the longitudinal bar 207 of the bed 201. This module 440 is similar to the module 400, except there are no flanges 406 projecting from the shell 404. In this arrangement, a connector such as a magnet is secured inside the shell 404, and the connector releasably connects the shell 404 to the steel bar 207. Again, persons skilled in the art will recognize that various module mounting arrangements or fastening means, including those mentioned and others, may be used without departing from the scope of the invention. Furthermore, many such arrangements will accommodate retrofitting the module 440 onto existing inversion tables.

The subject invention has been described with reference to specific embodiments and particular applications with the understanding that persons skilled in the art will derive additional embodiments that fall within the scope of the subject invention. In view of the foregoing, the subject invention should be limited only to the extent of allowable claims that issue from this application or any related application.

What is claimed is:

1. An inversion apparatus that supports a user in an inverted position relative to an underlying floor surface, comprising:

a base sized and configured to occupy a stable position relative to an underlying floor surface;

a supporting table rotatably mounted on the base for rotation about a horizontal axis, wherein the supporting table defines at least one back engaging surface; and an electronics unit mounted on the supporting table to accumulate data regarding use of the apparatus based on changes in orientation of the supporting table relative to the floor surface, wherein the supporting table defines a dedicated opening sized and configured to receive the electronics unit, wherein the electronics unit includes a mounting member configured and arranged to selectively engage the supporting table, wherein the electronics unit is magnetically attached to a steel bar on the supporting table.

2. The inversion apparatus of claim 1, wherein the electronics unit is in communication with a mobile phone app.

3. The inversion apparatus of claim 1, wherein the electronics unit collects data regarding frequency of inversions, duration of each inversion, and magnitude of each inversion.

4. A method of modifying an inversion apparatus that supports a user in an inverted position relative to an underlying floor surface, comprising the steps of:

providing an electronics unit operable to accumulate data regarding changes in orientation;

attaching the electronics unit to an inversion apparatus table with a mounting member, wherein the inversion apparatus table defines a dedicated opening for the electronics unit, the inversion apparatus table has a steel frame member, and the electronics unit has a magnet attached thereto, and the attaching step involves placing the electronics unit in the dedicated opening and placing the magnet in proximity to the steel frame member, wherein the inversion apparatus pivots relative to an underlying floor surface.

5. The method of claim 4, further comprising the step of placing the electronics unit in communication with a display device.

6. The method of claim 5, wherein the display device is incorporated into a mobile phone; wherein the placing step involves establishing a link between the electronics unit and the mobile phone.

7. An inversion apparatus that supports a user in an inverted position relative to an underlying floor surface, comprising:

a base sized and configured to occupy a stable position relative to an underlying floor surface;

a supporting table rotatably mounted on the base for rotation about a horizontal axis, wherein the supporting table defines at least one back engaging surface; and an electronics unit mounted on the supporting table to accumulate data regarding use of the apparatus based on changes in orientation of the supporting table relative to the floor surface; wherein the supporting table defines an opening sized and configured to receive the electronics unit, the electronics unit including a housing from which a flange extends, the flange positioned behind an upper bracket mounted to the supporting table, the housing configured to maintain the electronics unit within the opening of the supporting table.

8. The inversion apparatus of claim 7, wherein the flange is triangularly shaped.

9. The inversion apparatus of claim 7, wherein the housing includes two flanges.

10. The inversion apparatus of claim 7, wherein the upper bracket defines the opening in the supporting table.

11. The inversion apparatus of claim 10, wherein the supporting table includes a platform that is supported by the upper bracket; wherein the electronics unit is mounted between the upper bracket and the platform.

12. The inversion apparatus of claim 7, wherein the housing includes a shell and a cover, the flange extending outward from the shell.

13. The inversion apparatus of claim 7, wherein the electronics unit includes a mounting member configured and arranged to selectively engage the supporting table, wherein the mounting member is selected from the group consisting of a press fit, double-sided tape, hook and loop fastener, a screw, and a magnet.

* * * * *